United States Patent [19]

Fehrenbacher et al.

[11] 4,443,113

[45] Apr. 17, 1984

[54] ELECTROMECHANICAL TRIGGER FOR ALARM CLOCKS AND OTHER TIMER-OPERATED SIGNAL EMITTERS

[75] Inventors: Wolfgang Fehrenbacher, St. Georgen; Hans Heinzelmann, Schramberg; Erich Scheer, St. Georgen, all of Fed. Rep. of Germany

[73] Assignee: Kieninger & Obergfell, St. Georgen, Fed. Rep. of Germany

[21] Appl. No.: 257,854

[22] Filed: Apr. 27, 1981

[30] Foreign Application Priority Data

Apr. 25, 1980 [DE] Fed. Rep. of Germany ..... 3015982

[51] Int. Cl.[3] ..... G04B 23/02

[52] U.S. Cl. ..... 368/72; 368/250; 368/254; 368/262; 368/269

[58] Field of Search ..... 200/35 R, 37 A, 38 R, 200/38 A, 38 B, 38 C; 368/266, 250, 254, 262, 269, 72

[56] References Cited

U.S. PATENT DOCUMENTS

| | | | |
|---|---|---|---|
| 3,541,776 | 11/1970 | Ganter | 368/250 |
| 3,603,075 | 9/1971 | Wolber et al. | 200/38 R X |
| 3,738,098 | 6/1973 | Scheer | 368/266 |
| 4,069,658 | 1/1978 | Ito | 368/254 X |

FOREIGN PATENT DOCUMENTS

| | | | |
|---|---|---|---|
| 2947244 | 5/1981 | Fed. Rep. of Germany | 368/269 |

*Primary Examiner*—Ulysses Weldon
*Attorney, Agent, or Firm*—Karl F. Ross

[57] ABSTRACT

An alarm clock has a cambered leaf spring traversed by a nest of clock-hand shafts projecting from a mounting plate designed as a printed-circuit board. The leaf spring is supported at opposite ends by posts rising from the mounting plate and is limitedly swingable about a centerline parallel to that plate and perpendicular to the axis of the nested shafts. A toothed control disk centered on the same axis, with a hub carrying an alarm hand, is axially shiftable under pressure of the cambered leaf spring upon alignment of a tooth on that disk with a notch in an adjoining hour wheel; two diametrically opposite metallic contacts formed by lateral tongues on that spring then engage respective countercontacts on the mounting plate to close a circuit for the emission of an acoustic alarm signal. The alarm circuit can be broken by a manually displaceable interrupter lifting one of these tongues off its countercontact; with a modified alarm circuit, closure of one or the other contact pair can be selectively inhibited to enable the alternative operation of a buzzer or of a radio receiver upon displacement of the control disk by the leaf spring.

16 Claims, 6 Drawing Figures

ELECTROMECHANICAL TRIGGER FOR ALARM CLOCKS AND OTHER TIMER-OPERATED SIGNAL EMITTERS

FIELD OF THE INVENTION

Our present invention relates to an electromechanical trigger for a timer-operated signal emitter, especially but not exclusively for an alarm clock.

BACKGROUND OF THE INVENTION

In commonly owned U.S. patent application Ser. No. 209,275 filed Nov. 21, 1980 by one of us, Wolfgang Fehrenbacher, there has been disclosed an alarm clock provided with a buzzer or other signal generator which is actuated by the closure of contacts upon the axial shifting of an angularly settable control disk slidable on an hour shaft of the clockwork, the control disk and an adjoining hour wheel rigid with that shaft having mating formations such as a sawtooth-shaped cam and a cutout which are mutually aligned every 12 (or possibly every 24) hours. The disk is axially loaded by a leaf spring urging it toward the hour wheel; a tab on the spring is engageable by a detent for inhibiting or terminating the operation of the alarm. Also disclosed in that copending application is an escapement mechanism including a manually operable knob with a flexible stem which carries a pinion normally engaging gear teeth on the control disk; when rotation of that disk is blocked by its engagement with the hour wheel, the pinion is cammed out of meshing engagement with the disk teeth when a user turns the knob in an attempt to reset the alarm time.

The leaf spring disclosed in the copending application has one end fixedly secured to a boss rising from a mounting plate which is penetrated by an assembly of nested clockwork shafts including the aforementioned hour shaft. The opposite, free end of that spring can be engaged by the alarm-inhibiting detent and could also carry a movable contact element of a switch designed to close the operating circuit of the buzzer in the alignment position of the control disk and the hour wheel, even though the switch contacts actually shown in that application are closed by the control disk. In view of the cantilevered structure of the leaf spring, both the movable contact element and the inhibiting detent ought to be located as far as possible from the fixed end of that spring for reliable operation. There are, however, instances in which it would be more convenient to arrange both the switch contacts and the inhibiting means at some other point, e.g. in the vicinity of an axial plane transverse to the swing plane of the spring.

OBJECTS OF THE INVENTION

Thus, an object of our present invention is to provide an improved trigger mechanism of the aforedescribed character for the activation of normally inactive signal-generating means in an alarm clock or other timer-operated device which affords greater flexibility in the choice of locations for the switch contacts and associated inhibiting means while minimizing the risk of malfunction.

Another object is to provide a trigger mechanism of this type which can be selectively controlled to activate either or both of two mutually independent signal generators such as, for example, a buzzer and a radio receiver associated with an alarm clock.

SUMMARY OF THE INVENTION

An improved trigger mechanism according to our present invention comprises, as biasing means for axially shifting the control disk toward the coacting clockwork member (e.g. an hour wheel), a leaf spring with pivoted extremities which is swingable about a centerline parallel to a mounting plate supporting that spring and perpendicular to the axis of the control and coacting members. A pair of confronting contact elements on the mounting plate and on a portion of the leaf spring offset from its centerline, which form part of switch means for closing an operating circuit of associated signal-operating means in response to an axial shift of the control member in a predetermined angular position thereof relative to the coacting member, engage each other upon a substantially axial motion of an intermediate part of the leaf spring toward the mounting plate; such engagement can be inhibited or terminated by blocking means comprising an interrupter or detent which is interposable in the path of a lateral extension of the leaf spring adjacent its offset portion carrying one of the two confronting contact elements. Such interposition causes the leaf spring to rock about its centerline upon mutual engagement of the mating formations of the control and coacting members, thereby keeping these contact elements apart.

On account of the substantially unrestrained swingability—within limits—of the leaf spring about the centerline defined by its pivoted extremities, the lateral extension of that spring engageble by the interrupter can be disposed virtually anywhere along its centerline (which preferably but not necessarily lies in a longitudinal plane of symmetry of the spring) for effectively preventing the closure or insure the reopening of the operating circuit. It is preferable, however, to locate that extension on or near the intermediate part of the leaf spring bearing upon the control member.

Advantageously, pursuant to a more particular feature of this invention, the aforementioned offset portion of this intermediate spring part is one of two symmetrical tongues disposed at opposite sides of the centerline, the second tongue also carrying a contact element confronting another such element on the mounting plate. In one embodiment, the two contact elements on the leaf spring are serially interconnected, as are the two countercontacts on the mounting plate; in that instance it is necessary that both contact pairs are closed simultaneously in order to trigger the signal generator. In another embodiment, two mutually independent signal generators such as the buzzer and the radio receiver referred to above have separate operating circuits each including one of these contact pairs; this enables the selective activation of either or both signal generators as well as their separate blocking or deactivation.

BRIEF DESCRIPTION OF THE DRAWING

The above and other features of the present invention will now be described in detail with reference to the accompanying drawing in which.

SPECIFIC DESCRIPTION

Figure 2:
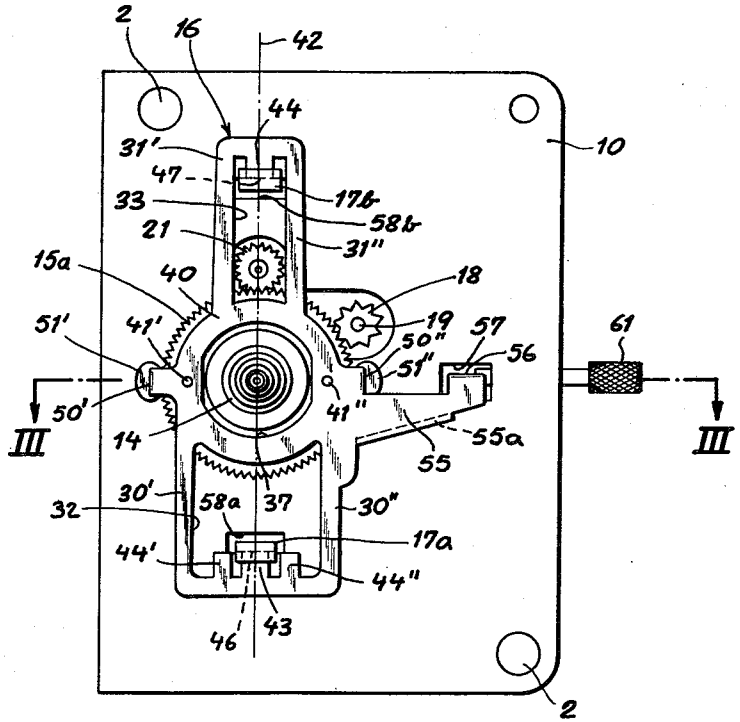
FIG. 2 is a face view of the assembly shown in FIG. 1.
Figure 1:
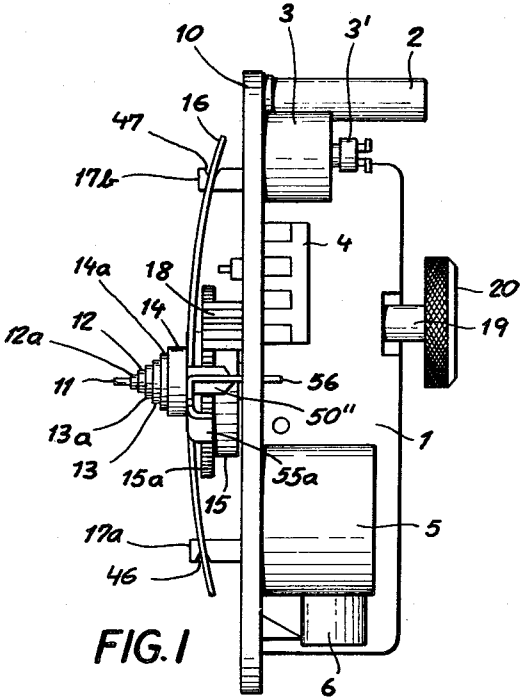
FIG. 1 is a somewhat diagrammatic side-elevational view of an alarm clock (with housing and hands omitted) provided with a trigger mechanism according to our invention.
Figure 3A:
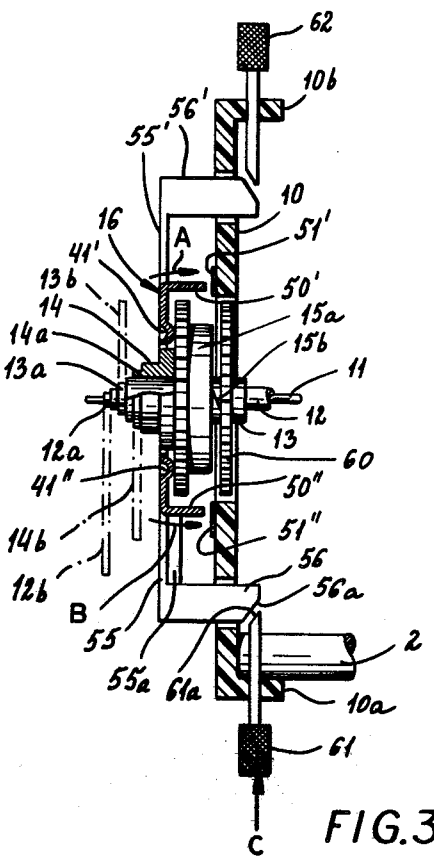
FIG. 3A is a view similar to FIG. 3, illustrating a modification.
Figure 3:
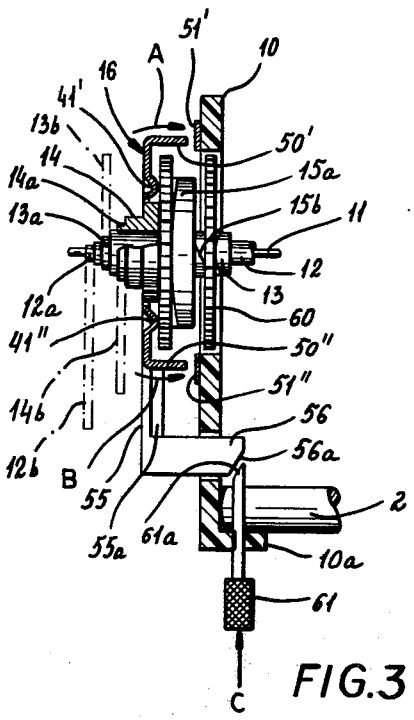
FIG. 3 is a cross-sectional view, partly in section, of the assembly of FIGS. 1 and 2 taken on the line III—III of FIG. 2.

In FIGS. 1–3 there is shown an alarm clock, generally similar to the timepiece disclosed in the aforementioned application Ser. No. 209,275, comprising a clockwork 1, a crystal-controlled oscillator 3 with trimming condenser 3', an integrated control circuit 4, a buzzer 5, and a power supply 6 in the form of one or more batteries all carried on a mounting plate 10 which is supported by corner posts 2 on a nonillustrated frame-work. Clockwork 1, of which only an hour wheel 60 (FIG. 3) in mesh with a pinion 21 (FIG. 2) has been illustrated, comprises the usual assembly of coaxially nested shafts including a seconds shaft 11, a tubular minute shaft 12 and a tubular hour shaft 13; wheel 60 is keyed to the last-mentioned shaft and along with pinion 21 is received in a cutout of mounting plate 10. Shafts 12 and 13 have annular shoulders 12*a* and 13*a* carrying a minute hand 12*b* and an hour hand 13*b*, respectively, as indicated in phantom lines in FIG. 3. A seconds hand at the tip of shaft 11 has not been illustrated.

Axially slidable on hour shaft 13 is a hub 14 of a control disk 15 provided with gear teeth 15*a*, the hub 14 having a shoulder 14*a* for the support of an alarm hand 14*b*. Gear teeth 15*a* are in mesh with a pinion 18 on a stem 19 which traverses the clockwork 1 and the mounting plate 10 and whose outer end carries a setting knob 20 for manual adjustment of the angular position of disk 15. Stem 19 may consist of elastomeric material and may be so mounted as to be laterally deflectable to disengage the pinion 18 from gear teeth 15*a*, as described in the copending application referred to, when the user rotates the knob 20 in a direction tending to delay the operation of the alarm but when disk 15 cannot be reverse-rotated on account of the interengagement of a sawtooth-shaped cam 15*b* thereof with an aligned notch (not shown) in the body of hour wheel 60. Also, stem 19 may be tubular and may pass with substantial friction through a square hole in an internal mounting plate (not shown) of clockwork 1. The disclosure of that copending application is hereby incorporated, by reference, in the present application.

Disk 15 is under axial pressure, tending to insert its tooth 15*b* into the associated notch of wheel 60, from a leaf spring 16 which spacedly overlies the mounting plate 10 and is supported thereon by a pair of posts 17*a*, 17*b* of rectangular profile having oppositely facing notches 46, 47. Posts 17*a* and 17*b* are spring legs which extend from the aforementioned internal mounting plate of clockwork 1 and pass through respective apertures 58*a* and 58*b* in plate 10; they are hooked into that plate for holding the clockwork in position thereon. Leaf spring 16 is longitudinally bisected by a plane of symmetry 42 including the common axis of shafts 11–13 and hub 14. The opposite extremities of this spring have cutouts 32, 33 bounded by lateral webs 30', 30" and 31', 31", respectively. A re-entrant lug 43 projects into cutout 32 from the wider end of spring 16 and has a transverse edge received in notch 46 of post 17*a*; similarly, a re-entrant lug 44 projects from the narrower opposite end of the spring into cutout 33 and has a tranverse edge received in notch 47 of post 17*b*. The points of contact between lugs 43, 44 and posts 17*a*, 17*b* define a centerline, located within plane 42, about which the spring 16 is swingable as indicated by two arrows A and B in FIG. 3; the swing is limited by webs 31', 31" straddling the post 17*b* and by additional webs 44', 44" straddling the post 17*a* inside cutout 32. The spring 16 is cambered away from mounting plate 10 in plane 42, with a concave side facing that plate, and tends to flatten so as to exert the aforementioned axial pressure upon hub 14. When disk 15 shifts under that pressure, spring 16 is slightly lengthened but remains positively anchored to the resilient legs forming these posts.

Figure 4:
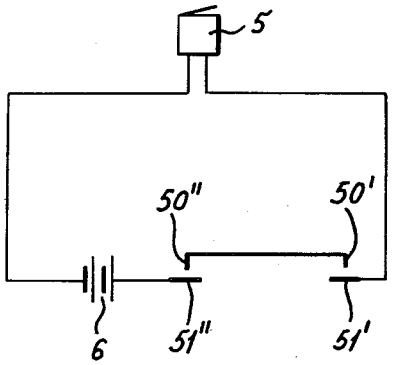
FIG. 4 illustrates an alarm circuit for the timepiece of FIGS. 1–3.

An intermediate annular part 40 of leaf spring 16, having a central aperture 37 traversed with slight clearance by the hub 14, bears via indentations 41', 41" upon the disk 15 and is provided at diametrically opposite locations with a pair of contacts in the form of integral tongues 50', 50" bent toward respective countercontacts 51' and 51" on the dielectric mounting plate 10 which is designed as a printed-circuit board. Normally, with tooth 15*b* riding on a solid part of hour wheel 60, tongues 50' and 50" are held separated from countercontacts 51' and 51" as seen in FIG. 3. Tongues 50' and 50", conductively interconnected by the metallic spring body, form part of an operating circuit for buzzer 5 as shown in FIG. 4, this circuit further including the battery 6 in series with the buzzer and with contacts 51' and 51". Thus, buzzer 5 will operate only upon simultaneous closure of both contact pairs 50', 50" and 51', 51" occurring when spring 16 is allowed to approach its flattened state upon alignment of tooth 15*b* with the associated notch of hour wheel 60. Buzzer 5, activated by this contact closure at a time determined by the angular presetting of disk 15 with the aid of knob 20, continues to generate sound until the tooth 15*b* is cammed out of its notch unless one of the contact pairs in its operating circuit is opened earlier.

In order to enable such an early deactivation of the buzzer, spring 16 is further provided with an integral extension in the form of a lateral arm 55 adjoining the tongue 51" but projecting radially beyond the latter. Arm 55 has a reinforcing rib 55*a* and terminates in a bent-over tab 56 which passes through an aperture 57 in plate 10 and has a beveled edge 56*a*. A manually operable interrupter 61, slidably carried out in a lateral flange 10*a* of plate 10, has a beveled tip 61*a* designed to coact with edge 56*a* of tab 56 for camming same outward when that interrupter is pushed from its illustrated withdrawn position into a working position as indicated by an arrow C. Such a displacement will cause the spring 16 to rock in a clockwise sense, as viewed in FIG. 3, about its pivotal axis represented by the aforementioned centerline which is defined by lodgments 46 and 47 in posts 17*a* and 17*b*. As a result, tongue 50" will be lifted off the fixed contact 51" to break the buzzer circuit.

By the same token, an inward displacement of interrupter 61 prior to the arrival of hour wheel 60 in its alignment position will prevent any movement of tongue 50" toward contact 51" whereby spring 16 will rock in the direction of arrow A to close only the contact pair 50', 51' when the tooth 15*b* drops into its notch. Interrupter 61 thus acts as a detent inhibiting or terminating the operation of buzzer 5.

Figure 5:
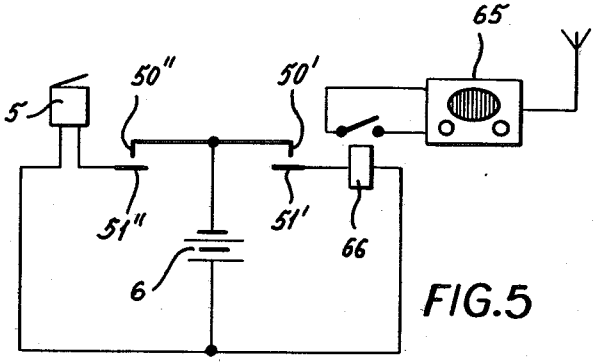
FIG. 5 illustrates a modified alarm circuit.

As indicated in FIG. 3A, mounting plate 10 can be extended on the side remote from arm 55 and can be provided with a flange 10*b* traversed by a similar interrupter 62 for coaction with a tab 56' of another lateral arm 55' integral with spring 16. Such a second interrupter will not be needed with the series circuit of FIG. 4 but would be useful when, as shown in FIG. 5, the alarm clock is associated with a radio receiver 65 adapted to be turned on by energization of a relay 66 in circuit with contacts 50', 51'. In this instance the buzzer 5 lies only in series with contacts 50'', 51'' and, as before, can be deactivated by a displacement of interrupter 61. The user, therefore, may decide to be awakened by the buzzer, by the radio or by a combination of both by depressing either or neither of interrupters 61, 62 before going to bed. When the alarm goes off with both interrupters withdrawn, the user may cut off the buzzer by depressing the interrupter 61 but may leave the radio on until relay 66 is released after, say, a half hour when tooth 15*b* is cammed out of its notch so that contacts 50', 51' are also reopened.

The radio receiver 65, of course, may have a knob of its own enabling its disconnection without the aid of interrupter 62. The presence of two interrupters 61, 62, however, will be useful when the buzzer and the radio are replaced by two sound and/or vibration generators, e.g. of the type placed under a pillow, designed to rouse two sleepers individually.

Interrupter 61 and lateral arm 55 need not be located in the region of annular part 40, as shown, but could be moved toward either extremity of leaf spring 16 without significantly affecting the mode of operation described above. One of these extremities may be used, by way of the associated post 17*a* or 17*b*, to supply current to contacts 50', 50'' in a circuit arrangement such as that of FIG. 5. It will also be possible to use a nonmetallic leaf spring by replacing each contact pair 50', 51' and 50'', 51'' with two closely juxtaposed contact pairs whose mobile contact elements or tongues are conductively interconnected and whose stationary countercontacts on plate 10 are all in series with the battery 6 and the associated signal generator in the manner illustrated for contacts 51', 51'' of FIG. 4. Obviously, battery 6 could be replaced by some other voltage source such as a secondary of a step-down transformer whose primary is connected by a cable to a utility outlet.

While interrupters 61, 62 are shown to be slidable, equivalent blocking means could be rotatably mounted on plate 10. Moreover, such an interrupter could also be disposed on the front side of that plate for interposition between the latter and the arm 55, for example.

We claim:

1. In a timer-operated signal emitter comprising a clockwork, a presettable control member coaxially juxtaposed with a coacting member of said clockwork, said members being provided with mating formations alignable with each other for interengagement in a predetermined relative angular position thereof, normally inactive signal-generating means, a trigger mechanism for activating said signal-generating means, said trigger mechanism including biasing means on a mounting plate perpendicular to the axis of said members bearing upon said control member for axially shifting same toward said coacting member in said predetermined position and switch means responsive to such an axial shift for closing an operating circuit of said signal-generating means, and blocking means for terminating or inhibiting closure of said operating circuit, the improvement wherein said biasing means comprises a leaf spring having an intermediate part between two extremities that are pivoted on said mounting plate with limited swingability about a centerline which lies in a longitudinal plane of symmetry of said leaf spring and passes through said extremities in a direction parallel to said mounting plate and perpendicular to said axis, said switch means including a pair of confronting contact elements respectively disposed on said mounting plate and on a portion of said leaf spring offset from said centerline engaging each other upon a substantially axial motion of the intermediate part of said leaf spring toward said mounting plate, said blocking means comprising an interrupter interposable in the path of a lateral extension of said leaf spring adjacent said offset portion for causing said leaf spring to rock about said centerline upon mutual alignment of said formations and keeping said pair of contact elements apart.

2. A signal emitter as defined in claim 1 wherein sid leaf spring is cambered away from said mounting plate between said extremities.

3. A signal emitter as defined in claim 2 wherein said extremities have cutouts with transverse edges received under tension in oppositely facing notches of a pair of posts projecting from said mounting plate.

4. A signal emitter as defined in claim 3 wherein said transverse edges are formed by re-entrant lugs in said cutouts, said lugs being flanked by lateral webs of said leaf spring bracketing said posts.

5. In a timer-operated signal emitter comprising a clockwork, a presettable control member coaxially juxtaposed with a coacting member of said clockwork, said members being provided with mating formations alignable with each other for interengagement in a predetermined relative angular position thereof, normally inactive signal-generating means, a trigger mechanism for activating said signal-generating means, said trigger mechanism including biasing means on a mounting plate perpendicular to the axis of said members bearing upon said control member for axially shifting same toward said coacting member in said predetermined position and switch means responsive to such an axial shift for closing an operating circuit of said signal-generating means, and blocking means for terminating or inhibiting closure of said operating circuit, the improvement wherein said biasing means comprises a leaf spring having an intermediate part between two extremities that are pivoted on said mounting plate with limited swingability about a centerline parallel to said mounting plate and perpendicular to said axis, said leaf spring having a first and a second tongue symmetrically disposed on opposite sides of said centerline, said switch means including a first contact element on said first tongue and a second contact element on said second tongue respectively confronting a third and a fourth contact element on said mounting plate for simultaneous engagement therewith upon a substantially axial motion of the intermediate part of said leaf spring toward said mounting plate, said blocking means comprising an interrupter interposable in the path of a lateral extension of said leaf spring adjacent said first tongue for causing said leaf spring to rock about said centerline upon mutual alignment of said formations and keeping said first and third contact elements apart.

6. A signal emitter as defined in claim 5 wherein said first contact element is connected in series with said second contact element and said third contact element is in series with said fourth contact element whereby closure of said operating circuit requires simultaneous engagement of said first and second contact elements with said third and fourth contact elements, respectively.

7. A signal emitter as defined in claim 5 wherein said first and third contact elements and said second and fourth contact elements constitute respective pairs of contact elements forming part of two separate operating circuits for the activation of two mutually independent signal generators in a withdrawn position of said interrupter.

8. A signal emitter as defined in claim 7 wherein said clockwork is part of an alarm clock, said signal generators being a buzzer controlled by said first and third contact elements and a radio receiver controlled by said second and fourth contact elements.

9. A signal emitter as defined in claim 8 wherein said blocking means further includes another interrupter operable to prevent closure of said second and fourth contact elements.

10. A signal emitter as defined in claim 5 wherein said clockwork is part of an alarm clock with an hour shaft and a minute shaft penetrating said mounting plate and traversing an opening in said intermediate part of said leaf spring, said control member having a hub slidable on said hour shaft.

11. A signal emitter as defined in claim 10 wherein said control member is a toothed disk angularly settable by a manually rotatable pinion in mesh therewith, said coacting member being an hour wheel rigid with said hour shaft.

12. A signal emitter as defined in claim 10 wherein said intermediate part of said leaf spring is annular and spacedly surrounds said shafts and said hub, said tongues being disposed on diametrically opposite locations of said annular part.

13. A signal emitter as defined in claim 12 wherein said lateral extension is an arm projecting radially beyond said first tongue and terminating in a beveled tab engageable by said interrupter.

14. A signal emitter as defined in claim 10 wherein said mounting plate has an aperture traversed by said tab, said interrupter being disposed on the side of said mounting plate opposite said leaf spring.

15. A signal emitter defined in claim 5, 10 or 12 wherein said mounting plate is a printed-circuit board.

16. A signal emitter as defined in claim 5, 10 or 12 wherein said centerline lies in a longitudinal plane of symmetry of said leaf spring.

* * * * *